United States Patent [19]

Wahle

[11] 4,285,679

[45] Aug. 25, 1981

[54] APPARATUS FOR SETTING UP SLIT-BOXES

[75] Inventor: Peter Wahle, Vellinge, Sweden

[73] Assignee: Sundpacma Aktiebolag, Malmo, Sweden

[21] Appl. No.: 75,236

[22] Filed: Sep. 13, 1979

[30] Foreign Application Priority Data

Sep. 15, 1978 [SE] Sweden ..... 7809765

[51] Int. Cl.[3] ..... B31B 5/02

[52] U.S. Cl. ..... 493/125; 493/180; 493/317

[58] Field of Search ..... 93/53 SD, 53 R, 53 BF, 93/53 M, 49 R; 493/123–126, 147, 181, 180, 183, 162, 317, 316, 313; 53/564, 566

[56] References Cited

U.S. PATENT DOCUMENTS

| | | | |
|---|---|---|---|
| Re. 27,631 | 5/1973 | Berney | 93/53 SD X |
| 2,280,773 | 4/1942 | Ferguson | 93/53 SD |
| 3,613,525 | 10/1971 | Lense et al. | 93/53 SD |
| 3,911,799 | 10/1975 | Klund | 93/53 SD X |
| 3,991,660 | 11/1976 | Calvert et al. | 93/53 SD |

*Primary Examiner*—James F. Coan

*Attorney, Agent, or Firm*—Larson and Taylor

[57] ABSTRACT

An improvement in an apparatus for setting up and closing the bottom of cartons or so called slit-boxes which are supplied as plainly collapsed carton tubes having sides and bottom and top flaps which are integral with the sides. The apparatus comprises a support (1) which carries a magazine (2) for carton blanks, a feeder unit (3) and a bottom flap closing means (4). The feeding unit (3) includes a suction catcher (11) adapted to catch and open a container blank and to move the said blank along a handling path while closing at least bottom thereof. The feeding unit carries an expelling means (27) having an expellor arm (28) which is moveable between a position inside the handling path and a position outside the handling path and which is mounted at a predetermined distance in front of the feeder unit (3) as considered in the feeding direction. The expellor arm (28) is actuated by a hydraulic or pneumatic cylinder (31) to move to a position inside the handling path when the suction catcher (11) starts to move along the handling path after having pulled a carton blank (6) out of the magazine (2) and to move the expellor arm (28) out of the handling path after the suction catcher with the expellor arm (28) and the set up carton has reached a predetermined end position and just before the suction catcher (11) starts to return to its initial position in contact with the foremost carton blank (6) of the magazine.

7 Claims, 6 Drawing Figures

APPARATUS FOR SETTING UP SLIT-BOXES

The present invention relates to an improvement of an apparatus for setting up slit-boxes of the type illustrated and described in the Swedish Pat. No. 361010.

The previously known apparatus which is designed for setting up and closing the bottom of so called slit-boxes which are supplied as a collapsed tubularly formed container or carton blank having sides and bottom flaps and top flaps which are integral with the said sides, comprises a support which carries a magazine for the collapsed tube-formed carton blanks, a feeding unit for pulling out and feeding a carton blank and a bottom closing means for folding in and possibly sealing the bottom flaps before the carton is filled. The feeding unit comprises a pneumatically acting catcher which is mounted perpendicularly to the feeding path and it is provided extendable so as to be able to catch a carton blank, pull same out of the magazine and together with the carton blank move along a feeding path while the carton is set up to tube form and the bottom flaps are folded in. At this stage the catcher is disengaged from the carton and moves back to catch another carton. In the previously known apparatus the feeding forward of the set up and bottom closed carton is made in that the carton is pushed forward by the following carton.

In most cases the said carton erecting apparatus is combined with a packing machine, and in such case it is essential that the set up carton is fed and stopped in an exact position for being filled. Previously the carton erecting apparatus used to be mounted adjacent the filling machine so that a ready set up carton is located exactly in the filling position after having been pushed forward by the following carton. In such apparatus, however, it is a need that the cartons have an exactly predetermined length which must be an even multiple of the distance to the packing machine onto which the cartons are moved. Consequently the combined machine is adjusted for just one length of the carton and when handling cartons of other dimensions the different machine units have to be mutually readjusted. In some cases the carton erecting apparatus is combined with a so called packing cradle in which the set up carton is rotated up from a horizontal position to a vertical position, and in the said vertical position the goods to be packed are pushed into the set up carton where upon the carton together with the goods are rotated back to horizontal position and is moved on for closing the top flaps. In the above described case, in which the cartons are fed forward by the subsequent carton it may, however, happen when folding the packing cradle down after the carton is filled that the said filled carton hooks on the subsequent empty carton what may cause problems in that the filled carton or the following empty carton is damaged or even tilts over.

The basic idea of the invention therefore is to provide a carton erecting apparatus which functions without any readjusting depending on different lengths of the cartons in the feeding direction and which always feeds the set up carton into an exact position for being filled and which apparatus eliminates the problems that a carton when being handled by a so called package cradle hooks on the following carton when being rotated down from the filling position to the feeding position.

According to the invention the above object is fulfilled in that the catcher and feeder means comprises a feeder arm which is mounted in an exact position in relation to the filling station connected thereto and which is rotatable between a position fully outside the feeding path for the set up carton and a position above the said feeding path. The feeder arm is mounted on the catcher and feeder apparatus and is moveable between and upright and a folded down position. When in its fold down position and when being moved by the catcher and the feader means the feeder arm contacts the rear side of the set up carton blank thereby moving the said carton blank into an exact position in the filling station. Since the feeder arm always contacts the rear side of the carton to move the carton into an exact position in the filling station the apparatus thereby functions independently of the size of the carton. Also the feeder arm is mounted in such position on the catcher and feeder apparatus that there is a space between the fed carton and the following carton even when handling the largest possible cartons, and this prevent cartons from hooking on each other independently of the way of filling the carton.

Further characteristics will be evident from the following detailed specification in which reference will be made to the accompanying drawings.

In the drawings:

FIG. 1 diagrammatically shows a carton erecting apparatus according to the invention in a vertical side view;

Figure 1:
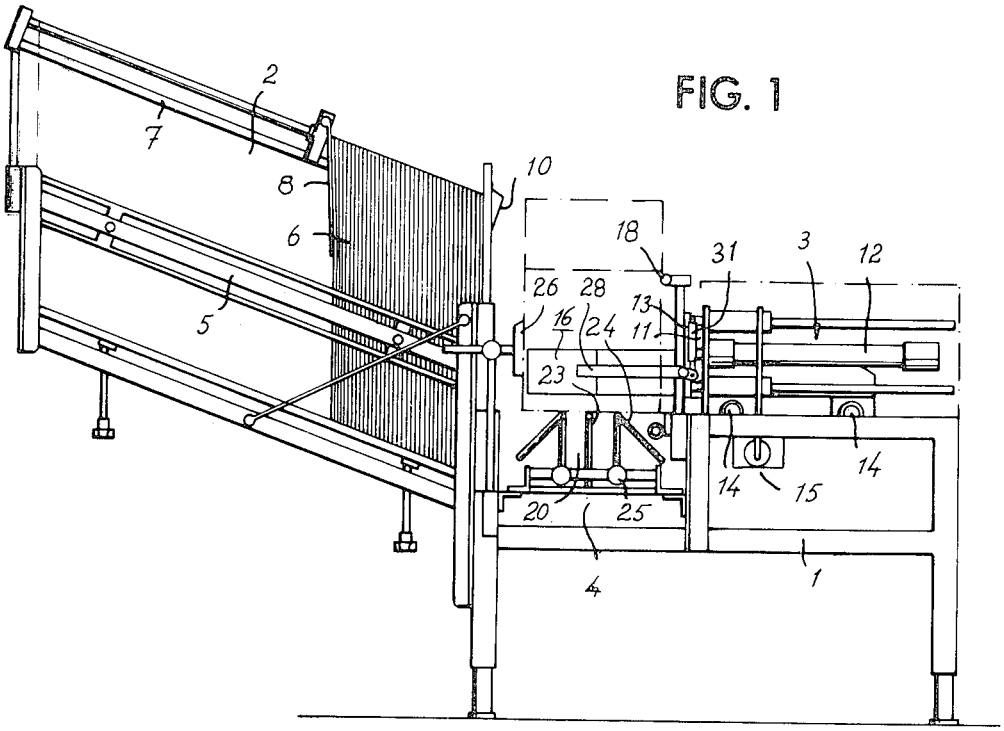
Figure 2:
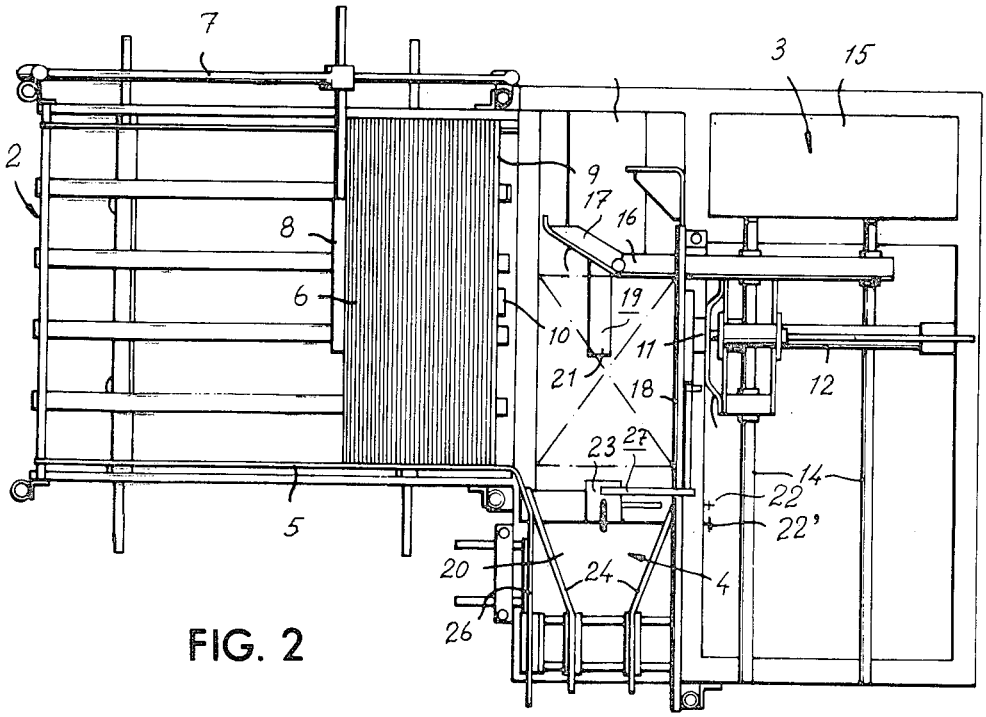
FIG. 2 shows the apparatus of FIG. 1 seen from above.
Figure 3:
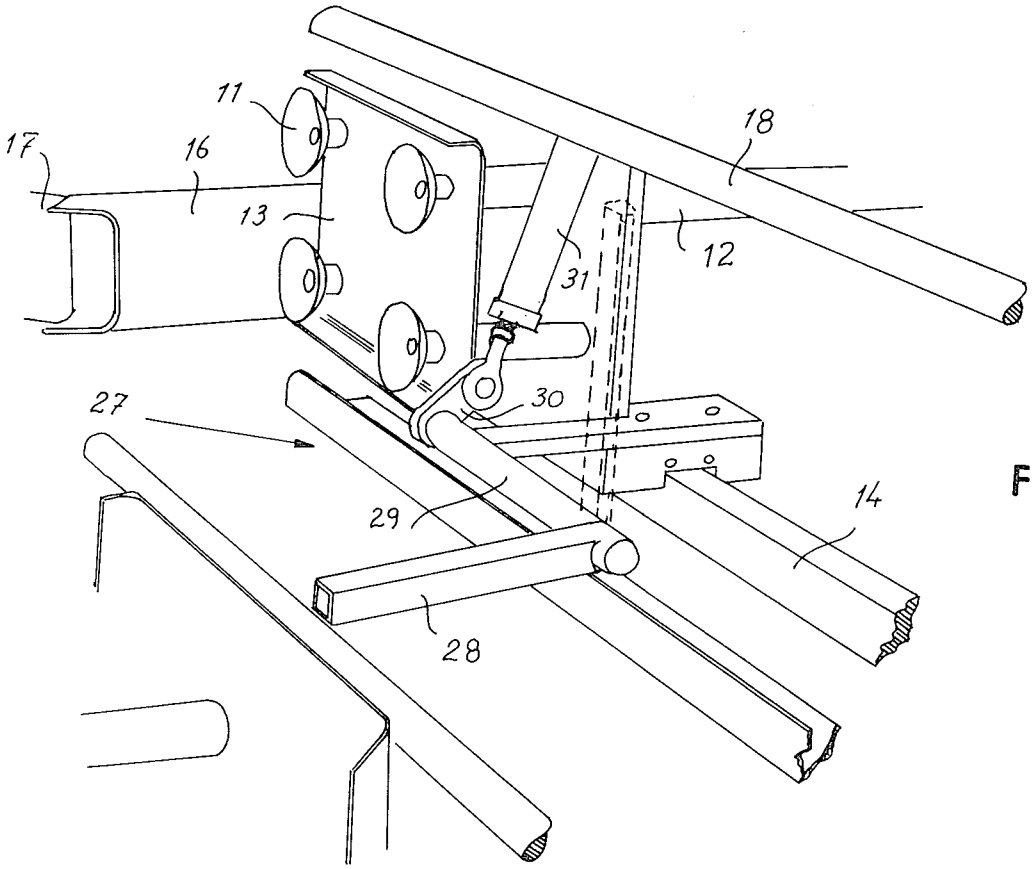
FIG. 3 is a perspective view of a part of the apparatus of FIGS. 1 and 2, and FIGS. 4*a*, 4*b* and 4*c* diagrammatically illustrate three different stages of the handling of slit-boxes with the apparatus according to the invention.

Referring to FIGS. 1 and 2 the apparatus comprises a support 1 which carries a magazine for carton blanks, a feeder unit for the opened carton blank and a means 4 or closing the bottom flaps of the carton. The magazine 2 extends out from one side of the support 1 whereas the feeder unit 3 and the bottom flap closing means are mounted inside the support.

In the conventional way the magazine comprises a carrier 5 for carton blanks having bottom side guides and at one end a guide 7 or a counter weight 8. The magazine is formed sloping towards the support, so that the carton blanks 6 which are standing in the magazine successively slip down into position for being set up into a slip box actuated by the counter weight 8. At its front end the guide 7 has a cross bar 9 supporting a resilient tongue acting both as a turnover tongue for the carton blanks and as a means for initiating the setting up of the carton blank. The cross bar 9 and the tongue 10 are adjustable in the vertical and in the horizontal direction for different large carton blanks.

As best evident from FIG. 2 the feeder unit comprises a suction catcher 11 which is connected to an air piston unit 12 which can extend the suction catcher 11 for seizing the front carton blank from the magazine. The suction catcher 11 comprises a plate 13 having suction cups which are connected to a vacuum pump (not illustrated). The suction catcher 11 together with the air piston 12 is moveable mounted on two parallel guides for movement along said guides by the actuation of an air piston unit 15 in connection to setting up the slit-box. The guides 14 and the air piston 15 are mounted on the support 1 for a movement parallely with the handling path for the slit box. An erecting and support bar 16 is mounted on the guides 14 and is connected with the suction catcher 11. The said erecting and support bar 16 extends substantially at right angle to the guides 14 and at the end thereof 17 facing the carton blanks a bar portion is rotatable actuated by an air piston so that the said end portion can be moved between and angular introduction position (full lines) and a fully straight position (dottied lines). The bar 16 is adjustable both in the direction parallely to the guides 14 and perpendicularly thereof for adopting the machine for different size cartons. In the handling path for the cartons there is a guide in the form of a tube 18 extending parallely with the guides 14. The guide tube 18 extends along the entire erecting zone and also along the bottom closing zone and it is provided for supporting the corresponding side of the carton during the erecting or setting up procedure.

The bottom closing means comprises two separate but coacting units, viz. a fold in means 19 for the rear inner flap of the carton and a system 20 of guide bars for folding in the front inner flap and the two side flaps of the carton. The fold in means 19 is mounted at the rear end of the handling path whereas the system 20 of guide bar is mounted at the front end or final end of the handling path.

The fold in means 17 for the rear inner flap comprises a rotatable wing 21 which can take either of two positions, viz. the first position vertically downwards in which the wing allows a carton blank 6 to be caught and pulled out of the magazine 2 and a second position in which the wing is rotated up thereby folding in the rear inner flap. The second position is taken when the carton blank is moved in the handling path. The folding up and folding down respectively of the wing 21 is made in any conventional way by means of a non-illustrated motor which is initiated by a contact 22. The system 20 of guide bars comprises a central bottom bar 23 for folding in the front inner flap of the carton and two mirror symetrical side bars 24 which successively plow in the side flaps of a carton while being moved forwards. The bottom bar 23 is adjustably mounted directly in the support whereas the side bars 24 are vertically and horizontally displaceably mounted in a holder 25 which in turn is mounted in the support. On the same level as the system 24 of guide bars there is also a support bar 26 which is mounted parallely with the guide tube 18 and which is intended to support the side of the carton facing the magazine. The support bar 26 is adjustable perpendicularly to the handling path for the carton thereby adopting the apparatus to different wide cartons.

An expelling means 27 is mounted on the suction catcher 11. The said expelling means comprises an expellor arm 28 which is rotatably mounted in a guide 29 for movement between a vertical position aside of the feeding path for the carton and a horizontal position at right angle to and above the feeding path for the carton. The expellor arm 28 is mounted on a shaft, which at the opposite end of the guide 29 has an actuation lug 30 connected to an air cylinder 31 for rotating the arm between its two extreme positions. The cylinder 31 is in turn connected to a non-illustrated contact means for providing the actuation of the expellor arm at a predetermined moment of the feeding.

Rather than using an air cylinder the expellor arm 28 maybe actuated by a guide cam or any similar means which automatically folds the expellor arm 28 down into the feeding path and out of the feeding path respectively. It is to be understood that the above described carton setting up machine is connected in front of a filling machine and for feeding a set up carton into an exact position of the filling machine the feeder arm 28 is mounted in such position along the feeding path and in relation to the path of motion of the suction catcher 11 that a carton moved by the expellor arm 28 comes into an exactly predetermined position in the filling unit with the rear side of the carton. For adapting the carton erecting apparatus to different types of filling machines the expellor arm maybe adjustable in the longitude and the direction of the feeding path.

Figure 4A:
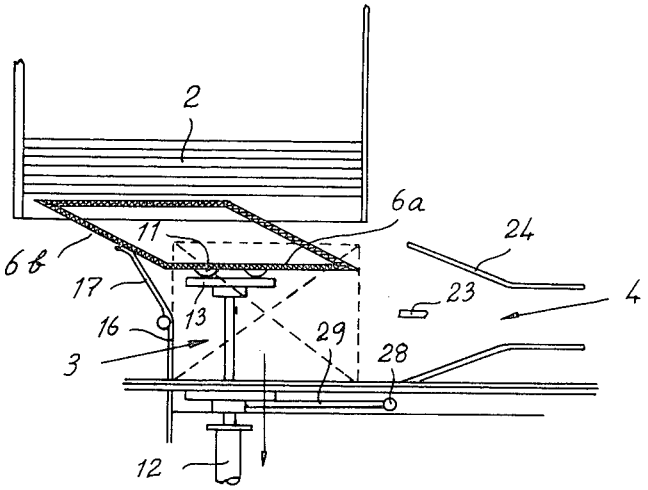
Figure 4B:
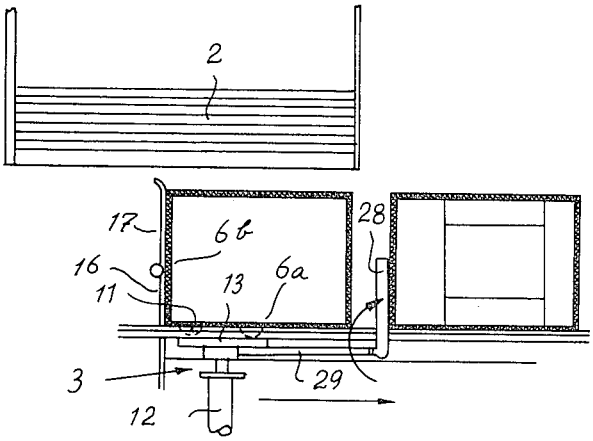
Figure 4C:
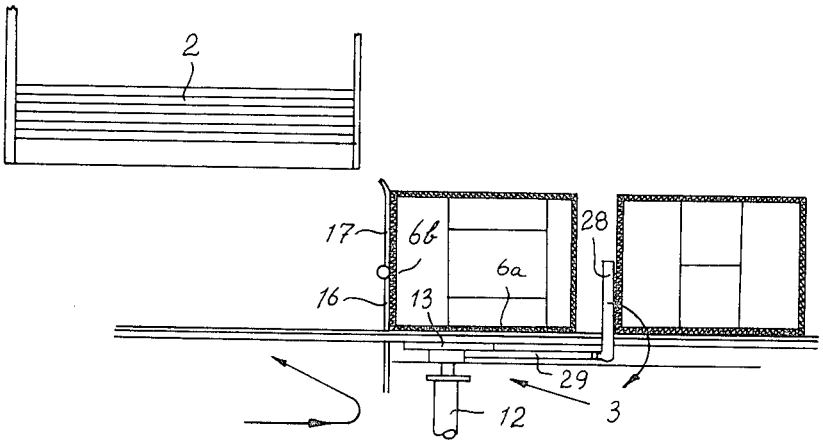

The erecting or setting up of a slit box is best explained in connection to FIG. 4 and is accomplished as follows: the carton blanks 6 are piled in the magazine 2 and the suction catcher 11, the support bar 16, the support bar 26, the fold in wing 21, the bottom bar 23 and the side bars 24 are adjusted according to the size and the type of carton blanks 6 of the magazine 2. The suction catcher 11 is put under vacuum and the air piston 12 thereof is expanded so that the suction catcher comes into contact with the foremost carton blank of the magazine. The suction catcher is mounted in such position in relation to the carton blanks as to seize only one side of the carton blank, in the illustrated case a long side. The suction plate 13 is thereafter pulled back, whereby it brings the front long side of the carton blank with itself. Since the carton blanks have been stored in a collapsed state it tends to bring also the rear layer of the carton blank. This is, however, prevented by the turned over tongue 10 which retains the top close flap of the front long side and the said front top close flap in turn retains the rear top close flap and the carton side which is integral therewith, thereby starting the setting up of the carton blank. When the suction catcher 11 has been pulled back some distance the fold over tongue 10 lets the front top close flap free and in turn folds down in front of the rear corresponding top close flap so as to retain the rear long side. Just following the said starting of the setting up of the carton blank, however, the front short side **6*b* hits the meeting surface of the support bar end 17, and during the continued setting up the fold over tongue 10 cooperates with the bar 16, 17 for the final setting up of the blank. When the blank is practically fully set up and the front long side 6*a* is brought into contact with the guide tube 18 it also hits the contact 22 thereby both causing the fold in wing 21 to rotate from its downwards directed position to its horizontal and forwards directed position whereby the rear inner flap is folded up and also causing the actuation means for the end 17 of the support bar to be straightened thereby providing a quite even support behind the carton as illustrated in FIG. 4*b*. The actuation of the contact 22 also initiates the air piston 15 to be expanded whereby the entire feeding unit is moved together with the set up container blank in the direction towards the bottom close means 4. When the plate 13 with the suction catcher 11 and the support bar 16** is moved it also brings the carton as an integral unit therewith.

The fold in wing 21 is long enough to keep the rear bottom flap fold up during a predetermined time of the movement of the carton along the feeding path. After the carton has been moved a short distance the bottom bar starts to fold in the front bottom flap, and in immediate connection thereto the side bars 24 start to plow up the bottom side flaps. As soon as the bottom side flaps are folded up they lock the inner flaps, and when the carton blank has reached as far as to pass the contact 22 and impulse is obtained for folding the bottom wing 21 down. The movement of the feeder unit 3 and the carton blank 6 goes on until a cam of the feeder unit 3 hits a second contact 22'.

Until now the expellor arm 28 has been in its fold down position some distance in front of the carton just set up and moved. During the movement of the said carton the expellor arm 28 has expelled a previously set up carton, and when the feeder unit 3 and the expelling means 27 reaches its end position the feeder arm 28 has moved the previously set up carton into an exact position of a non-illustrated filling unit connected to the setting up apparatus. The actuation of the second contact 22' provides a folding up of the expellor arm 28 to its vertical position aside of the feeder path, and the vacuum of the suction catcher 11 is disconnected, the suction plate 13 is withdrawn a short distance and immediately starts to return to its initial position at the same time as the plate 13 is pushed out. Consequently the suction plate moves along a curved path so that the plate 13 after the return movement has come into position to seize the next blank of the pile of carton blanks 6. When the feeder unit returns to its initial position the expellor arm 28 is actuated to once again be folded down over the feeder path and when the feeder unit is once again moved the expellor arm 28 contacts the rear side of the just set up carton and moves said carton into the said exact position of the filling station.

Since the expellor arm 28 is mounted at a predetermined distance from the suction catcher 11 the two cartons moved by the expellor arm 28 and the suction catcher 11 with the support bar 16 respectively are located at some distance from each other. Only the expellor arm 28 is determining the exact position of the rear side of the first set up carton. By the said apparatus different size and different formed containers can be handled without adjusting the feeder arm, and thanks to the distance between the two cartons being moved forwards the risk is eliminated that the cartons hook on each other or that there is a lack of exactness in the location of the carton in the filling station.

It is to be understood that the above specification and the embodiments thereof illustrated in the drawings are only illuminating examples and that all kinds of different modifications maybe presented within the scope of the appended claims.

We claim:

1. In an apparatus for setting up and bottom closing slit boxes which are supplied to the apparatus as collapsed carton tubes comprising sides and bottom flaps and top flaps integral therewith, said apparatus comprising a support which carries a magazine for the carton blanks, a feeder unit including a suction catcher means for pulling a blank out of the magazine, for setting up the blank to a tubular form and for moving the set up blank along a feeding path, bottom flap closing means provided along the feeding path of the suction catcher means for bottom closing the carton tube while the latter is moving along the feeding path, means for moving the suction catcher means in a first direction for successively catching and setting up carton blanks from the magazine and for moving the suction catcher means in a second direction along the feeding path while bottom closing the tubular carton blank and for returning the suction catcher means to the initial position thereof to enable catching of a further carton blank from the magazine, the improvement wherein the feeder unit including the suction catcher means carries an expelling means having an expellor arm which is rotatable between a first, inactive position wherein the expellor arm is located adjacent to the feeding path and a second, active position wherein the expellor arm is located inside the feeding path so as to engage a carton in said path and provide movement thereof independently of said suction means, said expellor arm being connected to the feeder unit at an adjustable distance downstream of the suction catcher means in the direction of movement along the feeding path so as to provide movement of a first carton blank along the feeding path while the suction catcher means moves a second carton blank along the feeding path, the position of the expellor arm being adjusted to said predetermined distance downstream of the suction catcher means.

2. Apparatus according to claim 1, wherein the expellor arm is connected to an actuation means which automatically moves the expellor arm into a position within the feeding path when the feeder unit starts to move back to the initial position thereof after an end position of the feeder unit is reached.

3. Apparatus according to claim 2, wherein the actuation means for the feeder arm comprises a hydraulic or pneumatic motor.

4. Apparatus according to claim 2, wherein the actuation means for the expellor arm is a guide cam which is mounted along the feeding path.

5. Apparatus according to claim 1, wherein the suction catcher means undergoes three different movements, and wherein the suction catcher means is connected to a suction means which is actuated during the first and second movements of the suction catcher means, whereby a carton blank is caught and expelled from the magazine and is set up to tubular form and is moved a predetermined distance along the feeding path, and which is deactuated during a third movement of the suction catcher means to release the carton, whereby the suction catcher means moves back along a curved path to the extended initial position thereof in contact with the next carton blank of the magazine.

6. Apparatus according to claim 5, wherein the expellor arm is directly connected to the suction catcher means to move therewith, and wherein means are provided for moving the expellor arm into said active position within the feeding path when the suction catcher means is in the initial position there for catching a carton blank and for moving the expellor arm to said inactive position out of the feeding path when the suction catcher means reaches the third and final position thereof prior to the time the suction catcher means moves back to the initial position thereof.

7. Apparatus according to claim 5 or 6, wherein the suction catcher means is movable with the expellor arm along the feeding path a distance which is at least as long as the maximum length of the carton blank to be set up thereby providing a space between the carton blanks in which the expellor arm can be moved into and out of the feeding path.

* * * * *